US011578731B2

(12) United States Patent
Wang et al.

(10) Patent No.: US 11,578,731 B2
(45) Date of Patent: Feb. 14, 2023

(54) ASYMMETRICAL DOUBLE-OUTLET BLOWER

(71) Applicant: Delta Electronics, Inc., Taoyuan (TW)

(72) Inventors: Yi-Han Wang, Taoyuan (TW); Chao-Fu Yang, Taoyuan (TW); Chih-Chung Chen, Taoyuan (TW); Shun-Chen Chang, Taoyuan (TW); Kuo-Tung Hsu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 17/345,917

(22) Filed: Jun. 11, 2021

(65) Prior Publication Data

US 2021/0388848 A1 Dec. 16, 2021

Related U.S. Application Data

(60) Provisional application No. 63/038,960, filed on Jun. 15, 2020.

(51) Int. Cl.

| | |
|---|---|
| ***F04D 29/42*** | (2006.01) |
| ***F04D 17/16*** | (2006.01) |
| ***F04D 29/62*** | (2006.01) |

(52) U.S. Cl.

CPC ..... *F04D 29/4246* (2013.01); *F04D 17/16* (2013.01); *F04D 29/624* (2013.01); *F04D 29/422* (2013.01)

(58) Field of Classification Search

CPC ..... F04D 29/4246; F04D 29/422; F04D 29/4226; F04D 17/16

See application file for complete search history.

(56) References Cited

U.S. PATENT DOCUMENTS 3,950,112 A * 4/1976 Crump ..... F04D 25/166 415/206
6,073,305 A * 6/2000 Hesskamp ..... F04D 29/4246 415/206

(Continued)

FOREIGN PATENT DOCUMENTS

CN 205744602 U 11/2016
CN 210688592 U 6/2020

(Continued)

*Primary Examiner* — Richard A Edgar
*Assistant Examiner* — Behnoush Haghighian
(74) *Attorney, Agent, or Firm* — Kirton McConkie; Evan R. Witt

(57) ABSTRACT

The disclosure relates to an asymmetrical double-outlet blower, including an upper case, a lower case and an impeller. The upper case includes an inlet. The lower case and the upper case are assembled to form a housing having an accommodation space, and form a first outlet and a second outlet. The accommodation space is in fluid communication with the first outlet, the second outlet and the inlet. The first outlet and the second outlet are disposed on a lateral periphery of the housing and face two opposite directions, respectively. An opening cross-sectional area of the first outlet is less than an opening cross-sectional area of the second outlet. The impeller is accommodated within the accommodation space of the housing, spatially corresponding to the inlet, and rotated around a rotation axis. An airflow is inhaled through the inlet and transported to the first outlet and the second outlet, respectively.

16 Claims, 13 Drawing Sheets

(56) References Cited

U.S. PATENT DOCUMENTS 6,643,129 B2 * 11/2003 Fujiwara ..... G06F 1/203 257/722
7,255,532 B2 * 8/2007 Zheng ..... F04D 29/424 415/203
8,075,257 B2 * 12/2011 Tien ..... G06F 1/20 415/203
8,206,099 B2 * 6/2012 Tsai ..... F04D 29/4246 415/206
8,313,284 B2 * 11/2012 Hirata ..... G06F 1/203 415/206
8,534,998 B2 * 9/2013 Liang ..... F04D 25/0613 415/206
8,662,832 B2 * 3/2014 Tsai ..... F04D 29/422 415/211.2
9,759,219 B2 9/2017 Oy
9,845,805 B2 * 12/2017 Bhutani ..... G06F 1/20
10,243,428 B2 * 3/2019 Lin ..... H02K 11/33
10,247,199 B2 * 4/2019 Lee ..... F04D 29/4246
10,436,223 B2 * 10/2019 Lee ..... F04D 29/422
10,465,697 B2 * 11/2019 Son ..... F24F 1/0014
10,539,150 B2 * 1/2020 Ling ..... F04D 29/582
10,752,141 B2 * 8/2020 Kim ..... F04D 29/667
10,982,684 B2 * 4/2021 Lin ..... F04D 17/16
11,131,324 B2 * 9/2021 Ozturk ..... F04D 29/663
2007/0160462 A1 * 7/2007 Tsang ..... F04D 29/4246 415/143
2008/0267764 A1 * 10/2008 Tsai ..... F04D 29/4246 415/53.3
2009/0324403 A1 * 12/2009 Zheng ..... F04D 25/0613 415/203
2010/0025022 A1 * 2/2010 Tien ..... G06F 1/20 415/203
2011/0110774 A1 * 5/2011 Horng ..... H05K 7/20172 415/208.1
2012/0237340 A1 * 9/2012 Tsai ..... F04D 29/422 415/148
2016/0369811 A1 * 12/2016 Ling ..... F04D 29/663
2017/0002829 A1 * 1/2017 Lee ..... F04D 29/282
2018/0106259 A1 * 4/2018 Lin ..... H02K 5/08
2018/0298914 A1 * 10/2018 Nakamura ..... B60H 1/00471
2019/0184868 A1 * 6/2019 Kim ..... F04D 29/441
2020/0208641 A1 * 7/2020 Tsuchida ..... F04D 25/166
2022/0106963 A1 * 4/2022 Li ..... F04D 29/4246

FOREIGN PATENT DOCUMENTS

TW M465478 U 11/2013
TW I651473 B 2/2019

* cited by examiner

ASYMMETRICAL DOUBLE-OUTLET BLOWER

CROSS-REFERENCE TO RELATED APPLICATION

This application claims the benefit of U.S. Provisional Application No. 63/038,960 filed on Jun. 15, 2020, and entitled "ASYMMETRICAL DOUBLE-OUTLET FAN PROVIDING EQUIVALENT PERFORMANCE UNDER DIFFERENT RESISTANCE". The entireties of the above-mentioned patent application are incorporated herein by reference for all purposes.

FIELD OF THE INVENTION

The present disclosure relates to a blower, and more particularly to an asymmetrical double-outlet blower for providing equivalent performances under different air resistances.

BACKGROUND OF THE INVENTION

A blower is a fluid machine applied to a wide range of application. In the prior art, the common blower includes a single outlet. In some application environments, such as a blower for air circulation in a vehicle, there is a need for double outlets. Two air currents, flowing not only in different directions but also in different air pressures, are provided through the double outlets, respectively, so that the two air currents with different volumetric flow rates are provided for the front seat and the rear seat of the vehicle, respectively. Since the double outlets correspond to different air pressures and different volumetric flow rates, there are two flow channels having different air resistances, and it is easy to interact with each other to reduce the overall efficiency. Therefore, comprehensive performances such as the volumetric flow rate, the air pressure, the energy consumption and the noise must be considered during design. Otherwise, the goal of optimizing uniform performances cannot be achieved.

Therefore, there is a need of providing an asymmetrical double-outlet blower for providing equivalent performances under different air resistances, and to obviate the drawbacks encountered from the prior arts.

SUMMARY OF THE INVENTION

It is an object of the present disclosure to provide an asymmetrical double-outlet blower. The blower includes a first outlet and a second outlet, served as a low-pressure outlet and a high-pressure outlet, respectively. An opening cross-sectional area of the high-pressure outlet is greater than that of the low-pressure outlet, so as to provide equivalent performances under different air resistances. Consequently, a high-pressure air current flowing from the inlet to the high-pressure outlet and a low-pressure air current flowing from the inlet to the low-pressure outlet are achieved.

It is another object of the present disclosure to provide an asymmetrical double-outlet blower. A channel length formed from the inlet to the low-pressure outlet is longer than that formed from the inlet to the high-pressure outlet, so as to provide equivalent performances under different air resistances. Consequently, a high-pressure air current flowing from the inlet to the high-pressure outlet and a low-pressure air current flowing from the inlet to the low-pressure outlet are achieved.

It is an additional object of the present disclosure to provide an asymmetrical double-outlet blower. With a cross section of the housing defined by a rotation axis, two cross-sectional heights are formed and correspond to the low-pressure outlet and the high-pressure outlet, respectively. The cross-sectional height corresponding to the low-pressure outlet is designed to be smaller than the cross-sectional height corresponding to the high-pressure outlet, so as to provide equivalent performances under different air resistances. Consequently, a high-pressure air current flowing from the inlet to the high-pressure outlet and a low-pressure air current flowing from the inlet to the low-pressure outlet are achieved.

It is a further object of the present disclosure to provide an asymmetrical double-outlet blower. While a connection line from the low-pressure outlet close to the high-pressure outlet is located through an inner lateral wall of the housing, a flow channel region in the housing is divided into a low-pressure flow channel region and a high-pressure flow channel region, and the projection area of the high-pressure flow channel region is designed to be greater than the projection area of the low-pressure flow channel region, so as to provide equivalent performances under different air resistances. Consequently, a high-pressure air current flowing from the inlet to the high-pressure outlet and a low-pressure air current flowing from the inlet to the low-pressure outlet are achieved.

In accordance with one aspect of the present invention, an asymmetrical double-outlet blower is provided and includes an upper case, a lower case and an impeller. The upper case includes an inlet. The lower case and the upper case are assembled to form a housing having an accommodation space, and form a low-pressure outlet and a high-pressure outlet. The accommodation space is in fluid communication with the low-pressure outlet, the high-pressure outlet and the inlet. The low-pressure outlet and the high-pressure outlet are disposed on a lateral periphery of the housing and face two opposite directions, respectively. An opening cross-sectional area of the low-pressure outlet is less than that of the high-pressure outlet. The impeller is accommodated within the accommodation space of the housing, spatially corresponding to the inlet, and rotated around a rotation axis. An airflow is inhaled through the inlet and transported to the low-pressure outlet and the high-pressure outlet, respectively.

In accordance with another aspect of the present invention, an asymmetrical double-outlet blower is provided and includes an upper case, a lower case and an impeller. The upper case includes an inlet. The lower case and the upper case are assembled to form a housing having an accommodation space, and form a low-pressure outlet and a high-pressure outlet. The accommodation space is in fluid communication with the low-pressure outlet, the high-pressure outlet and the inlet. The low-pressure outlet and the high-pressure outlet are disposed on a lateral periphery of the housing and face two opposite directions, respectively. A channel length formed from the inlet to the low-pressure outlet is longer than a channel length formed from the inlet to the high-pressure outlet. The impeller is accommodated within the accommodation space of the housing, spatially corresponding to the inlet, and rotated around a rotation axis. An airflow is inhaled through the inlet and transported to the low-pressure outlet and the high-pressure outlet, respectively.

In accordance with a further aspect of the present invention, an asymmetrical double-outlet blower is provided and includes an upper case, a lower case and an impeller. The upper case includes an inlet. The lower case and the upper case are assembled to form a housing having an accommodation space, and form a low-pressure outlet and a high-pressure outlet. The accommodation space is in fluid communication with the low-pressure outlet, the high-pressure outlet and the inlet. The low-pressure outlet and the high-pressure outlet are disposed on a lateral periphery of the housing and face two opposite directions, respectively. While a cross section of the housing is defined by the rotation axis, two cross-sectional heights are formed and correspond to the low-pressure outlet and the high-pressure outlet, respectively, wherein the cross-sectional height corresponding to the low-pressure outlet is smaller than the cross-sectional height corresponding to the high-pressure outlet. The impeller is accommodated within the accommodation space of the housing, spatially corresponding to the inlet, and rotated around a rotation axis. An airflow is inhaled through the inlet and transported to the low-pressure outlet and the high-pressure outlet, respectively.

In accordance with an additional aspect of the present invention, an asymmetrical double-outlet blower is provided and includes an upper case, a lower case and an impeller. The upper case includes an inlet. The lower case and the upper case are assembled to form a housing having an accommodation space, and form a low-pressure outlet and a high-pressure outlet. The low-pressure outlet and the high-pressure outlet are in fluid communication with the inlet through the accommodation space. The low-pressure outlet and the high-pressure outlet are disposed on a lateral periphery of the housing and face two opposite directions, respectively. While a connection line from the lower pressure outlet close to the high-pressure outlet is located through an inner lateral wall of the housing, a flow channel region in the housing is divided into a low-pressure flow channel region and a high-pressure flow channel region, wherein the high-pressure flow channel region corresponds to the high-pressure outlet, and a projection area of the high-pressure flow channel region is greater than that of the low-pressure flow channel region. The impeller is accommodated within the accommodation space of the housing, spatially corresponding to the inlet, and rotated around a rotation axis. An airflow is inhaled through the inlet and transported to the low-pressure outlet and the high-pressure outlet, respectively.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
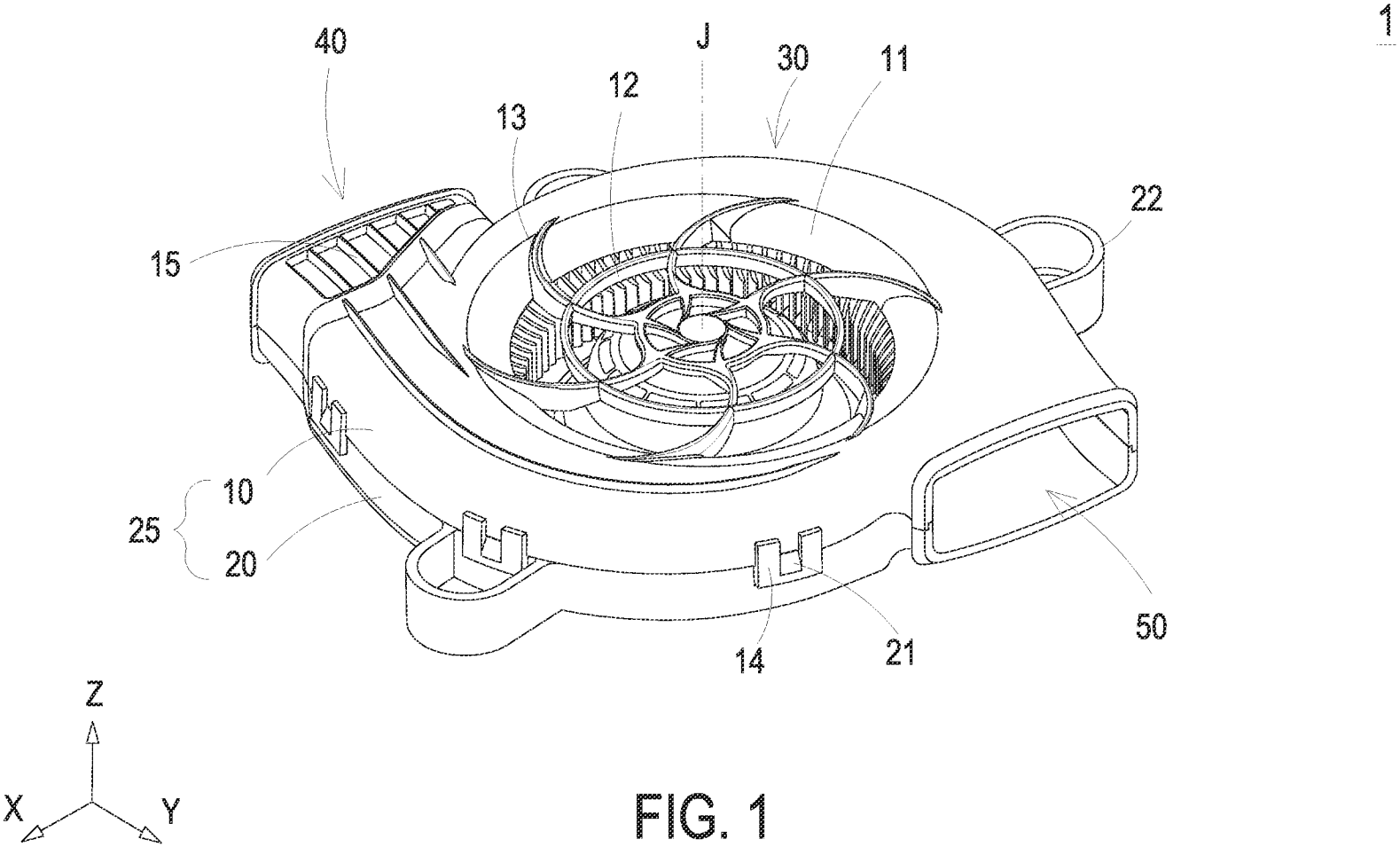
FIG. 1 is a stereoscopic structural view illustrating an asymmetrical double-outlet blower according to an embodiment of the present disclosure and taken from the upper perspective.

FIG. 1 is a stereoscopic structural view illustrating an asymmetrical double-outlet blower according to an embodiment of the present disclosure and taken from the upper perspective. In the embodiment, the asymmetrical double-outlet blower 1 (hereinafter referred to as the blower) includes an upper cover 10 and a lower case 20. The upper case 10 includes an inlet 30 facing toward for example the Z-axis direction shown in the drawings. Preferably but not exclusively, in the embodiment, the outer shape of the inlet 30 is circular. The upper case 10 further includes an inclined plane 11, a connecting ring 12 and a plurality of ribs 13. The inclined plane 11 is disposed around an outer periphery of the inlet 30. The rib 13 is disposed on the inlet 30 to prevent external matter from entering the inlet 30. The connecting ring 12 is connected to the rib 13 so as to strengthen the structural strength of the rib 13. Moreover, in the embodiment, the upper case 10 includes a plurality of fasteners 14, the lower case 20 includes a plurality of protrusions 21, and the plurality of fasteners 14 spatially correspond to the plurality of protrusions 21. Moreover, each of the fasteners 14 is buckled with the corresponding protrusion 21, so that the upper case 10 and the lower case 20 are assembled to form the housing 25, and form a first outlet served as the low-pressure outlet 40 and a second outlet served as the high-pressure outlet 50. In the embodiment, the low-pressure outlet 40 and the high-pressure outlet 50 are in fluid communication with the inlet 30 through the accommodation space of the housing 25, respectively. In the embodiment, the low-pressure outlet 40 and the high-pressure outlet 50 are disposed on a lateral periphery of the housing 25 and face two opposite directions, respectively. In the embodiment, an airflow is inhaled through the inlet 30, and discharged out through the low-pressure outlet 40 and the high-pressure outlet 50. The low-pressure outlet 40 and the high-pressure outlet 50 are configured to form the asymmetrical double outlets of the blower 1. Moreover, the airflow-pressure and the airflow volume of the high-pressure outlet 50 are greater than those of the low-pressure outlet 40. In the embodiment, the upper case 10 further includes a plurality of enhanced rib 15 disposed adjacent to the low-pressure outlet 40. In addition, the lower case 20 further includes a plurality of attachment portions 22 to fasten the blower 1 on an object, such as the bottom plane of the vehicle seat. Thus, different volumetric flow rates in different directions are achieved by the asymmetrical double outlets.

Figure 2:
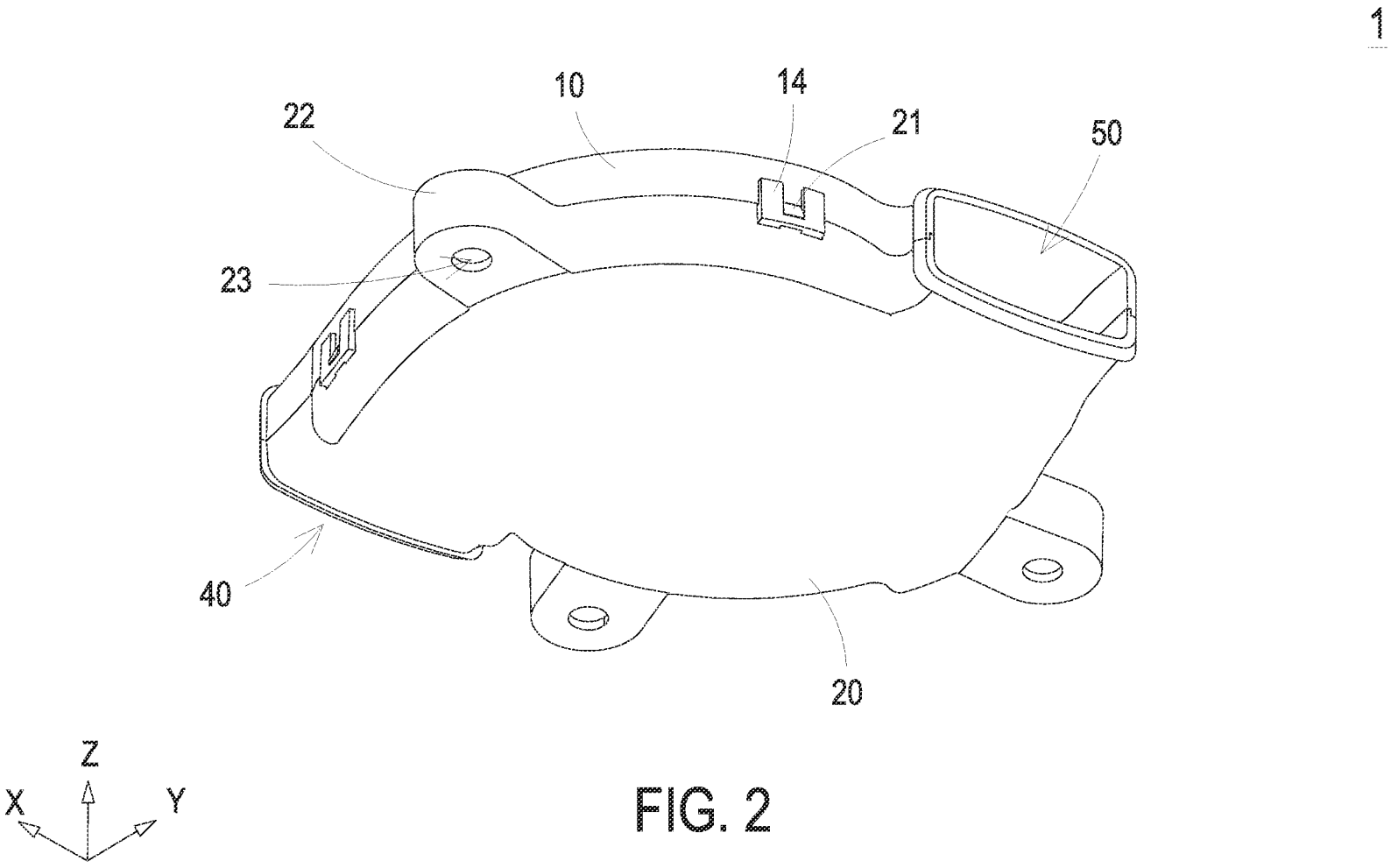
FIG. 2 is a stereoscopic structural view illustrating the asymmetrical double-outlet blower according to the embodiment of the present disclosure and taken from the below perspective.

FIG. 2 is a stereoscopic structural view illustrating the asymmetrical double-outlet blower according to the embodiment of the present disclosure and taken from the below perspective. In the embodiment, the lower case 20 includes three attachment portions 22 disposed adjacent to the outer periphery of the lower case 20. Preferably but not exclusively, each of the attachment portions 22 includes a screw hole 23 for fastening the blower 1 on the object. Preferably but not exclusively, with a screw or a bolt passing through the screw hole 23 of the attachment portion 22, the blower 1 is fastened on the bottom plane of the vehicle seat by the user, and the lower case 20 is attached to the bottom plane of the vehicle seat.

Figure 3:
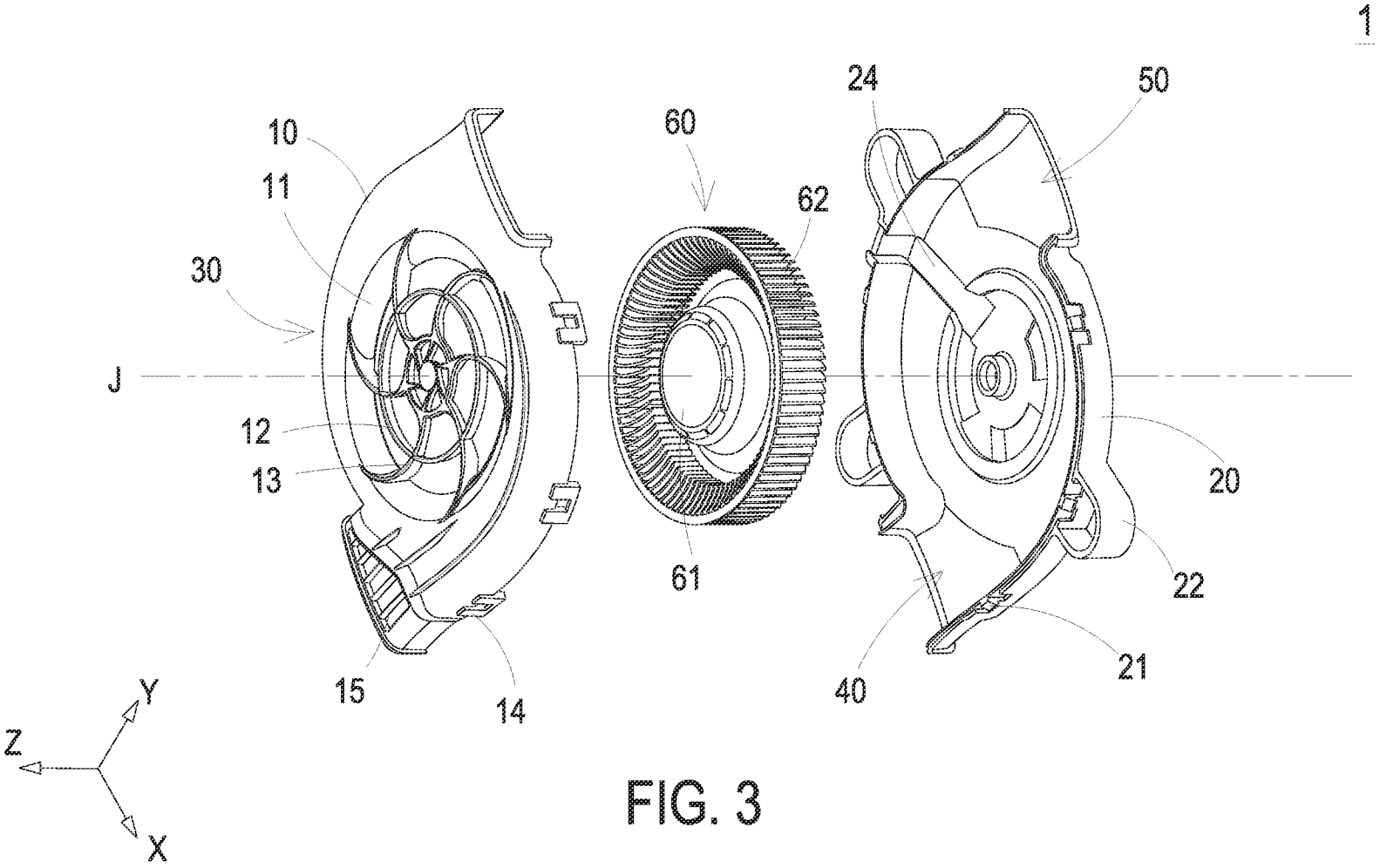
FIG. 3 is a schematic exploded view illustrating the asymmetrical double-outlet blower according to the embodiment of the present disclosure and taken from the upper perspective.

FIG. 3 is a schematic exploded view illustrating the asymmetrical double-outlet blower according to the embodiment of the present disclosure and taken from the upper perspective. In the embodiment, the blower 1 includes an impeller 60 disposed between the upper case 10 and the lower case 20. Namely, the impeller 60 is accommodated within the accommodation space of the housing 25 formed by assembling the upper case 10 and the lower case 20. The impeller 60 is rotated around a rotation axis J. Preferably but not exclusively, the rotation axis J is approximately located at the center of the inlet 30. The impeller 60 has a hub 61 spatially corresponding to the inlet 30 of the upper case 10. Moreover, the impeller 60 includes a plurality of blades 62 disposed around the outer periphery of the hub 61. The plurality of ribs 13 extend from the outer periphery of the inlet 30 toward the center of the inlet 30, are connected with the connecting ring 12, and cover the center of the inlet 30, so that the center of the impeller 60 is not exposed. When the impeller 60 is rotated around the rotation axis J, the airflow is guided from the inlet 30 through the impeller 60 to the low-pressure outlet 40 and the high-pressure outlet 50, respectively. Moreover, in the embodiment, the lower case 20 further includes a groove 24 recessed on the inner bottom surface of the lower case 20 for receiving an electric wire electrically connected to the motor in the impeller 60 from the outside. Certainly, the present disclosure is not limited thereto.

Figure 4:
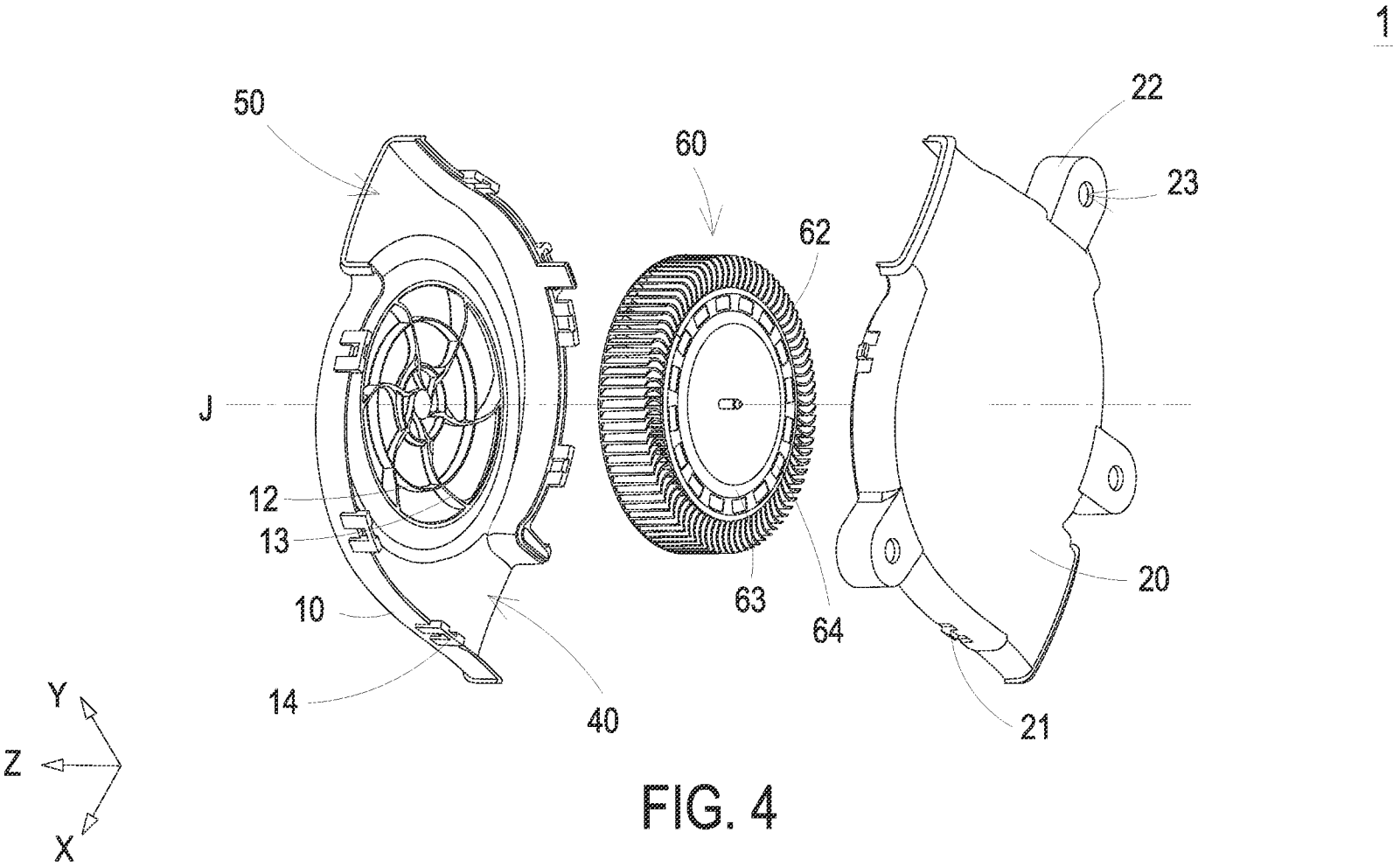
FIG. 4 is a schematic exploded view illustrating the asymmetrical double-outlet blower according to an embodiment of the present disclosure and taken from the below perspective.

FIG. 4 is a schematic exploded view illustrating the asymmetrical double-outlet blower according to an embodiment of the present disclosure and taken from the below perspective. In the embodiment, the impeller 60 of the blower 1 further includes a magnet 63 and a plurality of recesses 64. The magnet 63 is located inside the impeller 60 and arranged in a ring shape. The plurality of recesses 64 are disposed around the bottom surface of the impeller 60 and located between the blades 62 and the magnet 63. In the embodiment, when the impeller 60 is driven to rotate around the rotation axis J, the airflow is inhaled into the blower 1 through the inlet 30 in the axial direction, and then discharged out through the low-pressure outlet 40 and the high-pressure outlet 50 in the radial direction. With the structural arrangement of the upper case 10 and the lower case 20, the flow channel from the inlet 30 to the low-pressure outlet 40 and the flow channel from the inlet 30 to the high-pressure outlet 50 are formed as two asymmetrical with unequal volumes, so as to provide equivalent performances under different air resistances. Consequently, a low-pressure air current flowing from the inlet 30 to the low-pressure outlet 40 and a high-pressure air current flowing from the inlet 30 to the high-pressure outlet 50 are achieved. The detailed structural features of the upper case 10 and the lower case 20 are described later.

Figure 5:
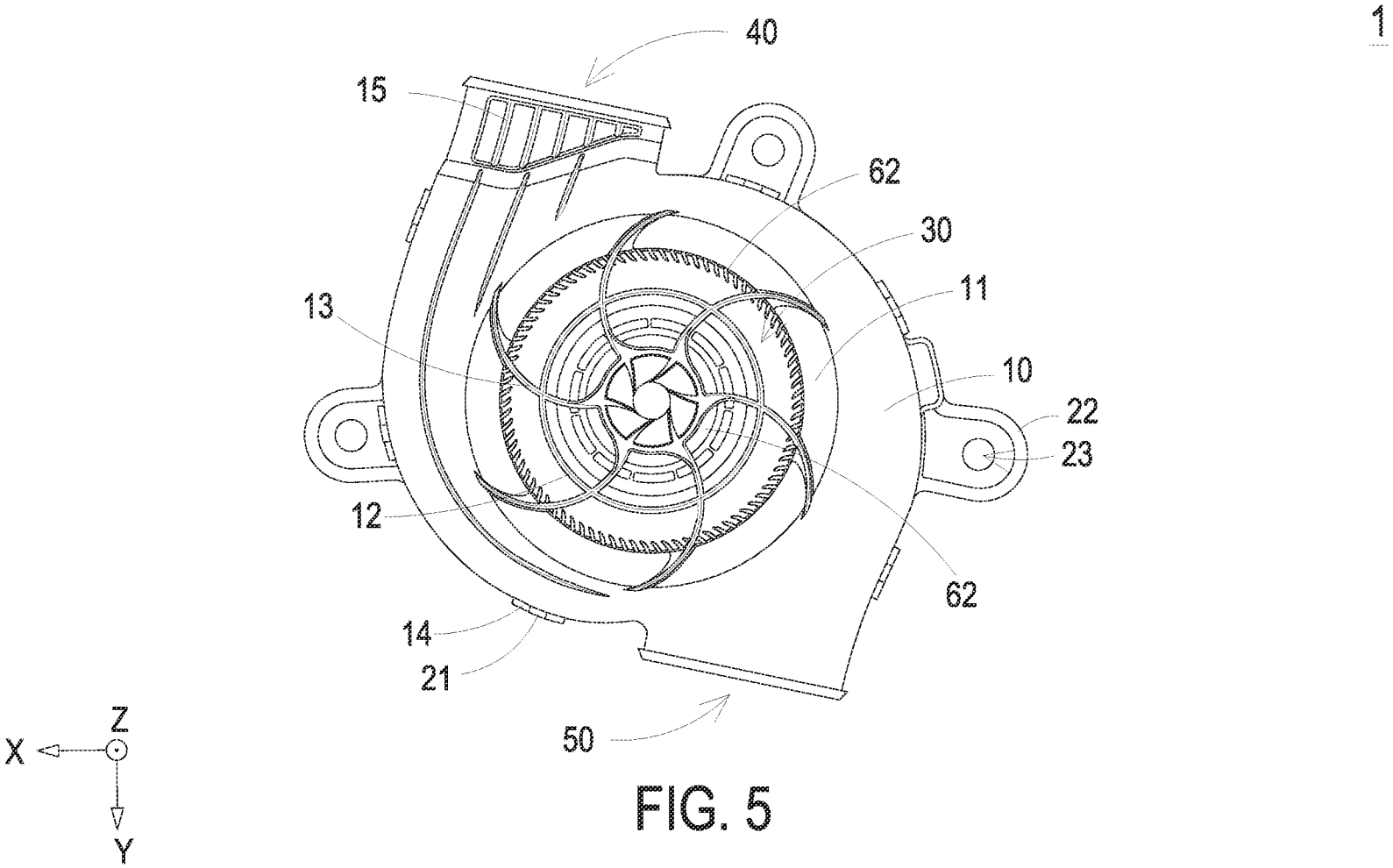
FIG. 5 is a top view illustrating the asymmetrical double-outlet blower according to the embodiment of the present disclosure.

FIG. 5 is a top view illustrating the asymmetrical double-outlet blower according to the embodiment of the present disclosure. In the embodiment, inlet 30 faces the Z-axis direction. The plurality of blades 62 of the impeller 60 are arranged radially and disposed around the outer periphery of the hub 61. The plurality of blades 62 are at least partially exposed to the inlet 30. When the impeller 60 is driven to rotate, the airflow is introduced from the inlet 30 and then transported along the XY plane. Two flow channels with unequal volumes are formed from the inlet 30 to the low-pressure outlet 40 and from the inlet 30 to the high-pressure outlet 50, respectively, so as to provide the asymmetric double outlets of the blower 1. In the embodiment, the opening cross-sectional area of the low-pressure outlet 40 is less than that of the high-pressure outlet 50. Moreover, the flow channel formed from the inlet 30 to the low-pressure outlet 40 has a smaller cross-sectional area than that of the flow channel formed from the inlet 30 to the high-pressure outlet 50. Based on the design of the same height level, a plurality of enhanced ribs 15 are formed on the outer surface of the upper case 10 and disposed adjacent to the low-pressure outlet 40 without increasing the overall height of the blower 1 in the Z-axis direction. Moreover, in the embodiment, the upper case 10 includes the inclined plane 11 corresponding to the outer periphery of the inlet 30. The connecting ring 12 is located in the inlet 30 and arranged in a concentric circle with the inlet 30. In that, the rotation axis J of the blower 1 passes through the center of the connecting ring 12. The plurality of ribs 13 are extended inwardly from the outer periphery of the inlet 30 toward the center of the inlet 30, pass through the connecting ring 12, respectively, and converged at the center of the inlet 30, so as to cover the center of the inlet 30. Preferably but not exclusively, the plurality of ribs 13 are arranged at equal distances from each other and form a counterclockwise vortex to match the airflow direction of the inlet 30. Certainly, the present disclosure is not limited thereto. In other embodiments, the form of the inclined plane 11, the number of connecting ring 12, the number of ribs 13, and the bending form are adjustable according to the practical requirements, and not redundantly described hereafter. In other words, the inlet 30 constructed by the inclined plane 11, the connecting ring 12 and the plurality of ribs 13 has the characteristics of a counterclockwise vortex, there is none of through openings or through holes located at the center of the inlet 30, and the center of the impeller 60 is not exposed in the Z-axis direction.

Figure 6:
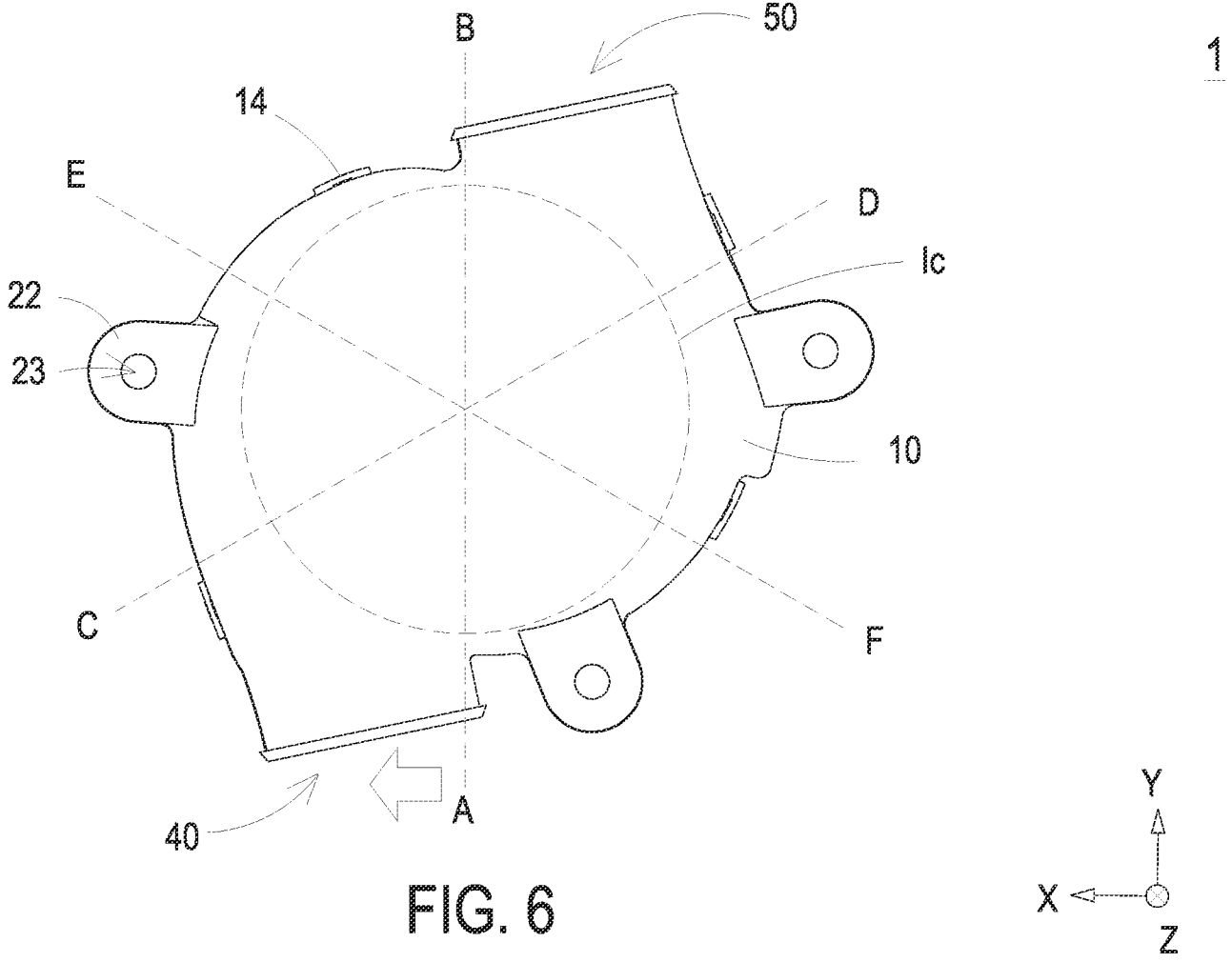
FIG. 6 is a bottom view illustrating the asymmetrical double-outlet blower according to the embodiment of the present disclosure.

FIG. 6 is a bottom view illustrating the asymmetrical double-outlet blower according to the embodiment of the present disclosure. In order to further explain the flow channel formed from the inlet 30 to the low-pressure outlet 40 and the flow channel formed from the inlet 30 to the high-pressure outlet 50, the line $\overline{AB}$ is a straight line from a side of the low-pressure outlet 40 to a side of the high-pressure outlet 50, and passed through the rotation axis J. Furthermore, the line $\overline{AB}$, the line $\overline{CD}$ and the line $\overline{EF}$ passing through the rotation axis J are used to divide the impeller circumference Ic into six equal parts. The flow channel formed from the inlet 30 to the low-pressure outlet 40 and the flow channel formed from the inlet 30 to the high-pressure outlet 50 are different on the cross sections formed by the line $\overline{AB}$, the line $\overline{CD}$ and the line $\overline{EF}$ passing through the rotation axis J, and described later.

Figure 7:
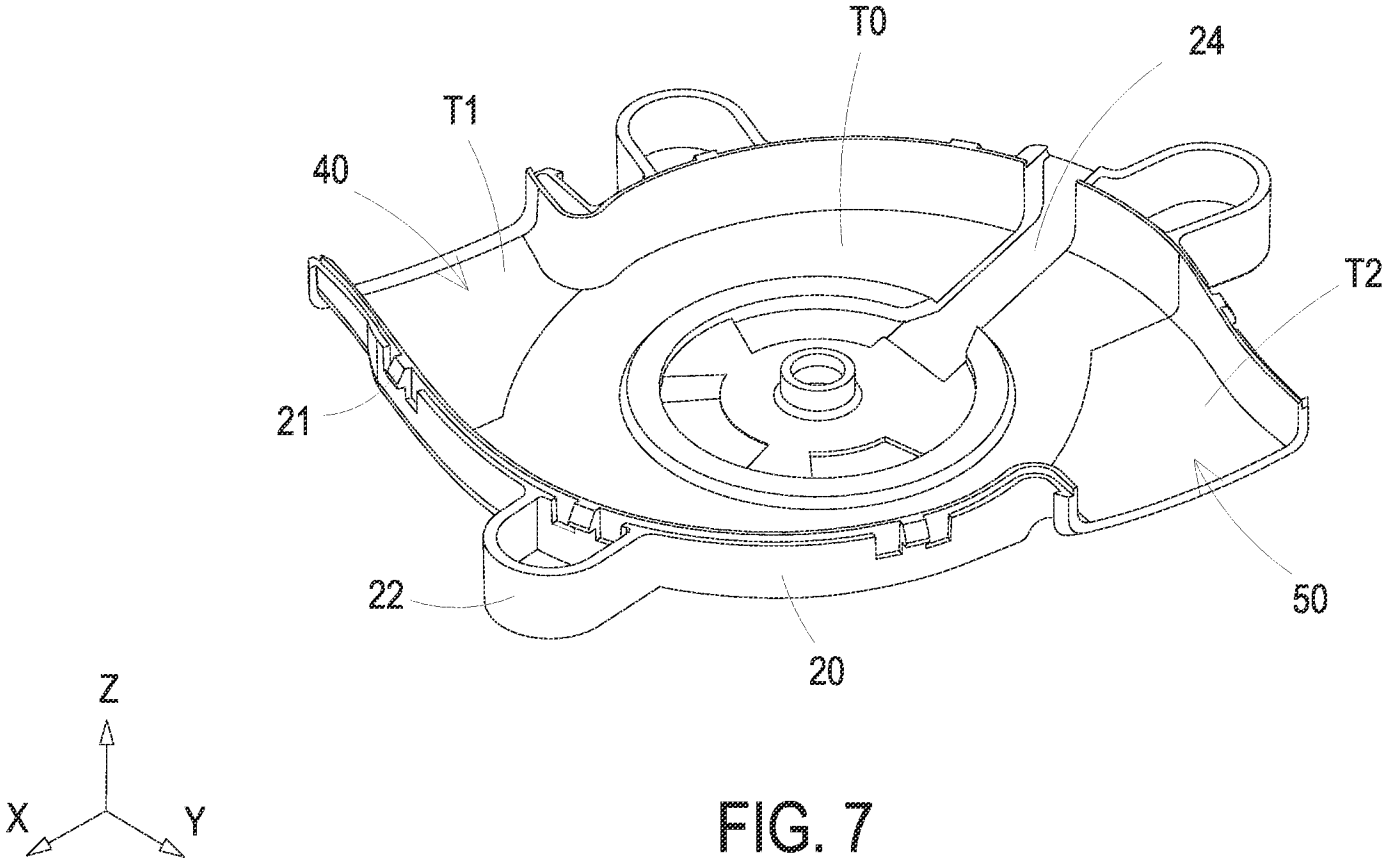
FIG. 7 is a stereoscopic structural view illustrating the lower case of the asymmetrical double-outlet blower according to the embodiment of the present disclosure and taken from the upper perspective.

FIG. 7 is a stereoscopic structural view illustrating the lower case of the asymmetrical double-outlet blower according to the embodiment of the present disclosure and taken from the upper perspective. In the embodiment, the lower case 20 includes a bottom plane T0, a first inclined plane T1 and a second inclined plane T2 disposed on the inner surface thereof and corresponding to the inlet 30, the low-pressure outlet 40 and the high-pressure outlet 50, respectively. Preferably but not exclusively, the bottom plane T0 is a flat plane. The bottom plane T0 spatially corresponds to the inlet 30 and the blades 62 of the impeller 60. The first inclined plane T1 is extended from the bottom plane T0 to the low-pressure outlet 40, and the second inclined plane T2 is extended from the bottom plane T0 to the high-pressure outlet 50. A slope of the first inclined plane T1 is different from that of the second inclined plane T2. Preferably but not exclusively, the slope of the first inclined plane T1 is greater than that of the second inclined plane T2. In that, the flow channel formed from the inlet 30 to the low-pressure outlet 40 has a smaller cross-sectional area compared to that of the flow channel formed from the inlet 30 to the high-pressure outlet 50, so as to provide equivalent performances under different air resistances. Consequently, a low-pressure air current flowing from the inlet 30 to the low-pressure outlet 40 and a high-pressure air current flowing from the inlet 30 to the high-pressure outlet 50 are achieved. In the embodiment, the groove 24 is concavely formed on the bottom plane T0, but does not affect the flow channel formed from the inlet 30 to the high-pressure outlet 50.

Figure 8:
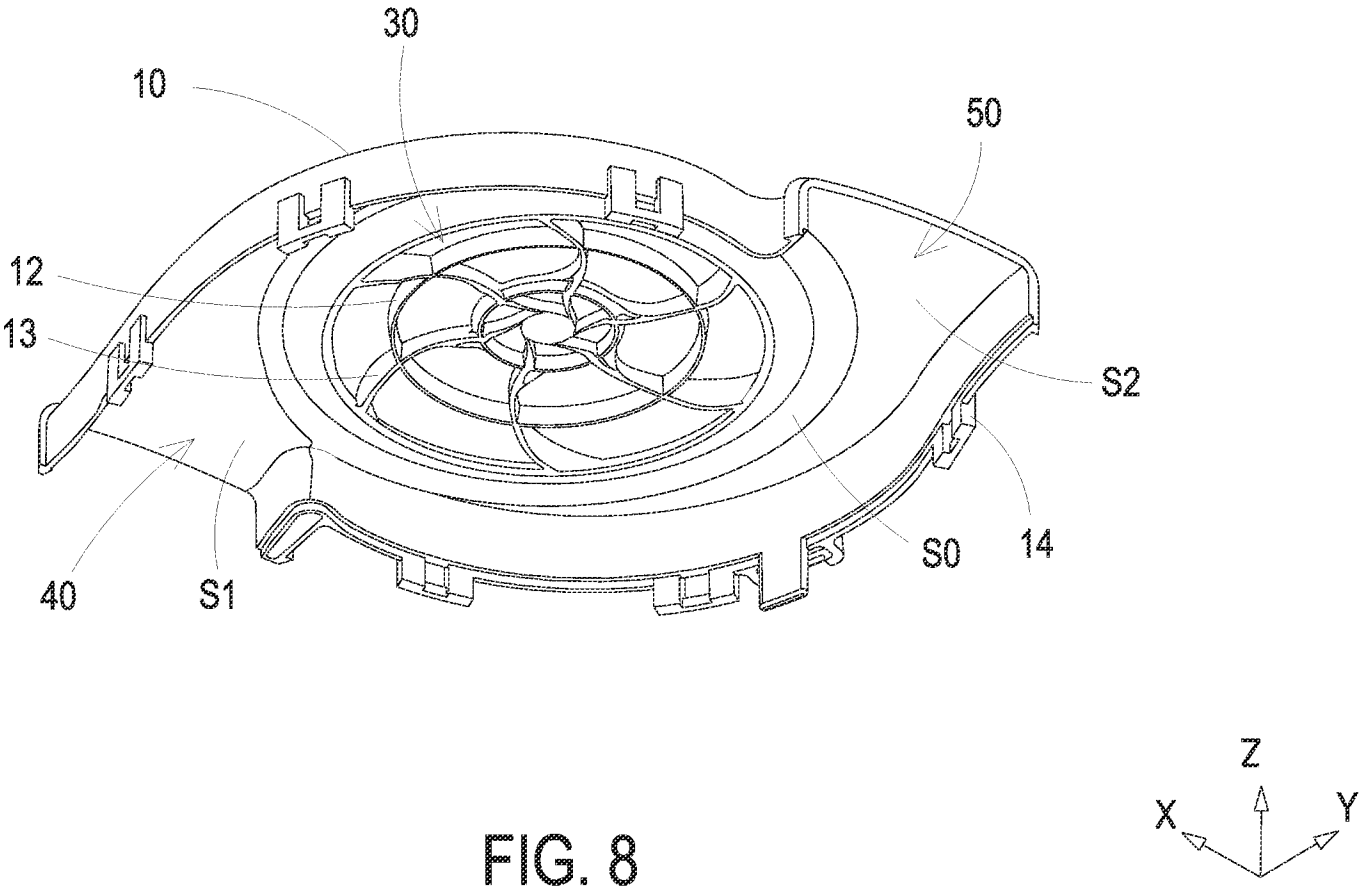
FIG. 8 is a stereoscopic structural view illustrating the upper case of the asymmetrical double-outlet blower according to the embodiment of the present disclosure and taken from the below perspective.

FIG. 8 is a stereoscopic structural view illustrating the upper case of the asymmetrical double-outlet blower according to the embodiment of the present disclosure and taken from the below perspective. In the embodiment, the inlet 30 is constructed by the inclined plane 11, the connecting ring 12 and the plurality of ribs 13 of the upper case 10. In addition, the inclined plane 11 further protrudes toward an interior of the housing 25 of the blower 1, so as to guide the air to flow into the blower 1. Moreover, in the embodiment, the upper case 20 includes a first top plane S0, a second top plane S1 and a third top plane S2 disposed on the inner surface thereof, respectively, and corresponding to the inlet 30, the low-pressure outlet 40 and the high-pressure outlet 50. The first top plane S0 is located at the outer periphery of the inclined plane 11 and connected to the inclined plane 11. The second top plane S1 is extended from the first top plane S0 to the low-pressure outlet 40, and the third top plane S2 is extended from the first top plane S0 to the high-pressure outlet 50. In the embodiment, the first top plane S0, the second top plane S1 and the third top plane S2 have different horizontal heights corresponding to the XY plane, respectively. Taking the first top plane S0 as a reference, the second top plane S1 protrudes from the horizontal height of the first top plane S0 to the interior of the blower 1, and the third top plane S2 is recessed from the horizontal height of the first top plane S0 to the exterior of the blower 1, so that the horizontal height of the second top plane S1 is less than that of the first top plane S0, and the horizontal height of the third top plane S2 is greater than that of the first top plane S0. In that, the flow channel formed from the inlet 30 to the low-pressure outlet 40 has a smaller cross-sectional area compared to that of the flow channel formed from the inlet 30 to the high-pressure outlet 50, so as to provide equivalent performances under different air resistances. Consequently, a low-pressure air current flowing from the inlet 30 to the low-pressure outlet 40 and a high-pressure air current flowing from the inlet 30 to the high-pressure outlet 50 are achieved.

Figure 9A:
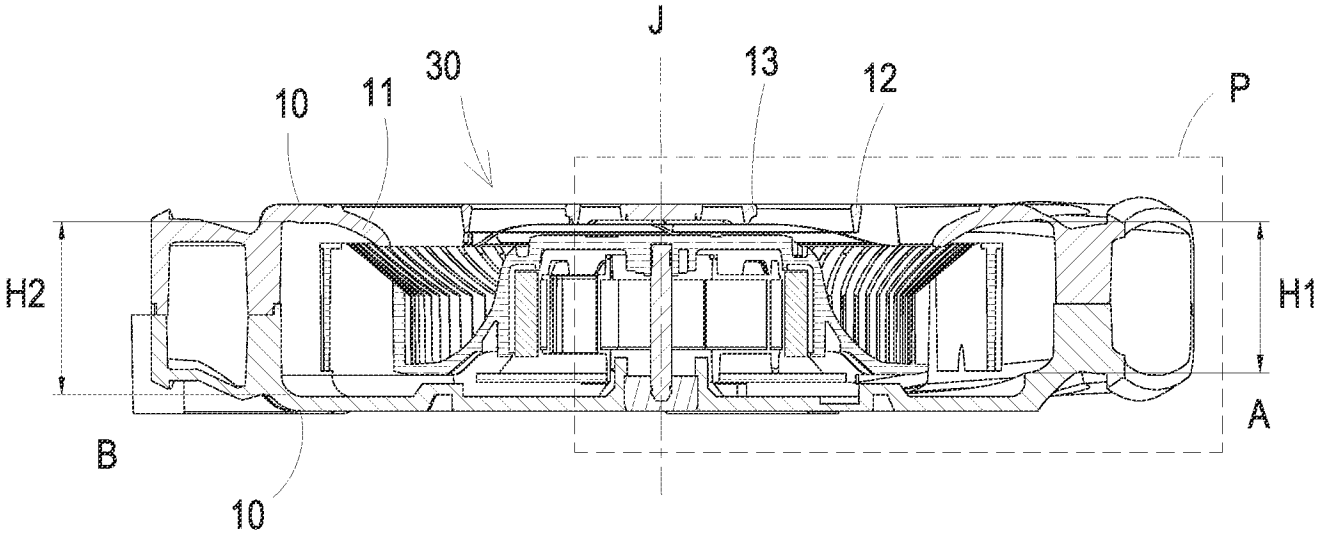
FIG. 9A is a cross-sectional view illustrating the asymmetric double-outlet blower according to the embodiment of the present disclosure and taken along the line $\overline{AB}$ shown in FIG. 6.

FIG. 9A is a cross-sectional view illustrating the asymmetric double-outlet blower according to the embodiment of the present disclosure and taken along the line $\overline{AB}$ shown in FIG. 6. Please refer to FIGS. 6 and 9. In the embodiment, the flow channel formed from the inlet 30 to the low-pressure outlet 40 has a first cross-sectional height H1 on the cross section taken along the line $\overline{AB}$, and the flow channel formed from the inlet 30 to the high-pressure outlet 50 has a second cross-sectional height H2 on the cross section taken along the line $\overline{AB}$. In the embodiment, the first cross-sectional height H1 is smaller than the second cross-sectional height H2. In that, the flow channel formed from the inlet 30 to the low-pressure outlet 40 has a smaller cross-sectional area compared to that of the flow channel formed from the inlet 30 to the high-pressure outlet 50, so as to provide equivalent performances under different air resistances. Consequently, a low-pressure air current flowing from the inlet 30 to the low-pressure outlet 40 and a high-pressure air current flowing from the inlet 30 to the high-pressure outlet 50 are achieved.

Figure 9B:
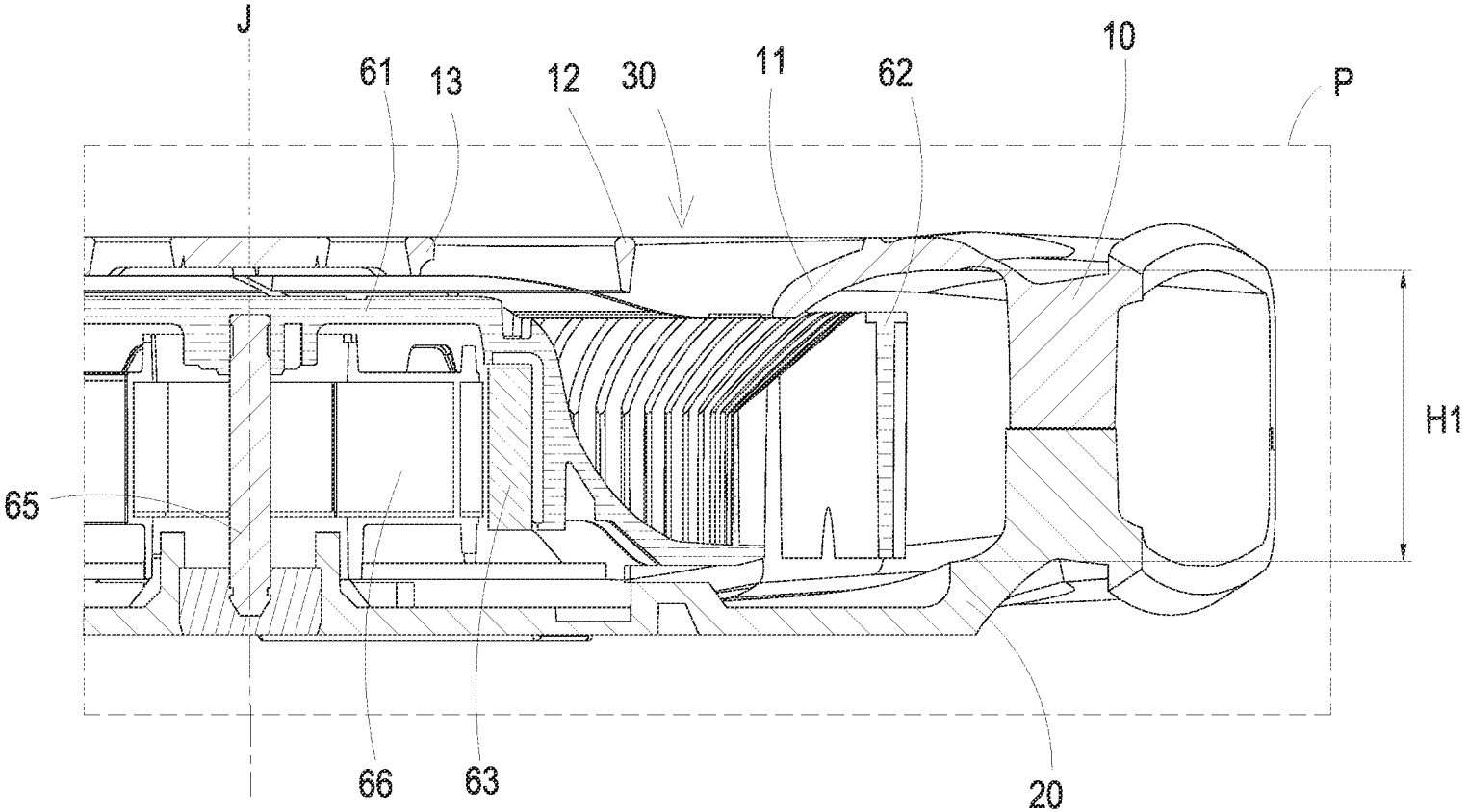
FIG. 9B is a partial enlarged view of the area P shown in FIG. 9A.

FIG. 9B is a partial enlarged view of the area P in FIG. 9A. In the embodiment, the hub 61 includes a shaft 65 disposed along the rotation axis J of the blower 1. The impeller 60 further includes a stator 66 corresponding to the magnet 63, so as to form a motor for driving the impeller 60. In the embodiment, an outer-rotor motor is used to drive the impeller 60. Moreover, in the embodiment, the inclined plane 11 of the upper case 10 is extended toward the inlet 30 and has an arc-shaped cross-sectional structure. In the embodiment, the inner periphery of the plurality of blades 62 is exposed through the inlet 30, the outer periphery of the plurality of blades 62 is covered by the upper case 10, and the height of each blade 62 increases along the radial direction so that the maximum height of each blade 62 is located at the outermost periphery. The inclined plane 11 and the blades 62 are overlapped in the Z-axis direction. Thereby, when the impeller 60 drives the blade 62 to rotate, the airflow is guided from the air inlet 30 into the blower 1 along the inclined plane 11, and flows to the flow channels formed by the low-pressure outlet 40 and the flow channel formed by the high-pressure outlet 50, respectively. The asymmetrical double outlets of the present disclosure are achieved.

Figure 10:
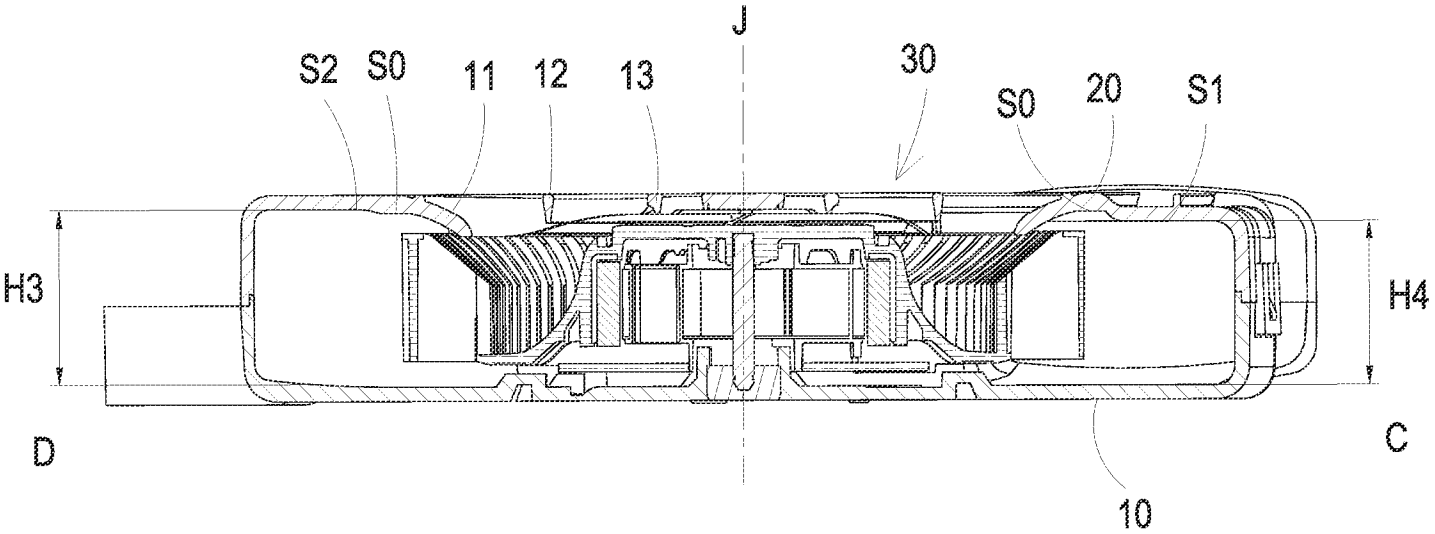
FIG. 10 is a cross-sectional view illustrating the asymmetric double-outlet blower according to the embodiment of the present disclosure and taken along the line $\overline{CD}$ shown in FIG. 6.

FIG. 10 is a cross-sectional view illustrating the asymmetric double-outlet blower according to the embodiment of the present disclosure and taken along the line $\overline{CD}$ in FIG. 6. Please refer to FIG. 6 and FIG. 10. In the embodiment, the flow channel formed from the inlet 30 to the high-pressure outlet 50 has a third cross-sectional height H3 on the cross section taken along the line $\overline{CD}$, and the flow channel formed from the inlet 30 to the low-pressure outlet 40 has a fourth cross-sectional height H4 on the cross section taken along the line $\overline{CD}$. In the embodiment, the third cross-sectional height H3 is greater than the fourth cross-sectional height H4. In that, the flow channel formed from the inlet 30 to the high-pressure outlet 50 has a larger cross-sectional area compared to that of the flow channel formed from the inlet 30 to the low-pressure outlet 40, so as to provide equivalent performances under different air resistances. Consequently, a high-pressure air current flowing from the inlet 30 to the high-pressure outlet 50 and a high-pressure air current flowing from the inlet 30 to the low-pressure outlet 40 are achieved.

Figure 11:
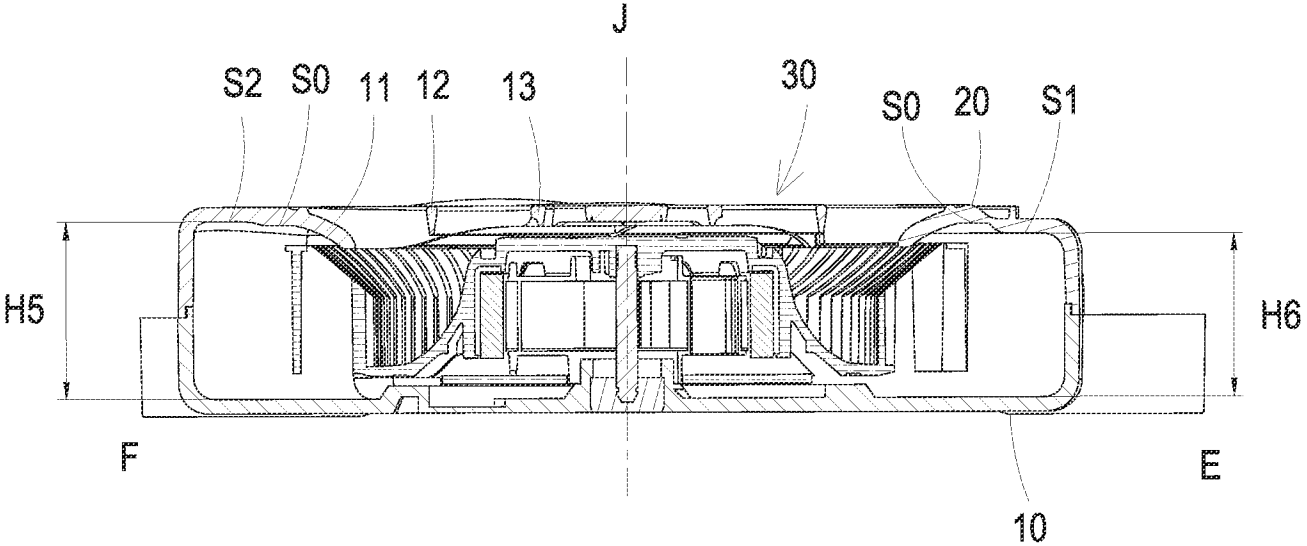
FIG. 11 is a cross-sectional view illustrating the asymmetric double-outlet blower according to the embodiment of the present disclosure and taken along the line $\overline{EF}$ shown in FIG. 6.

FIG. 11 is a cross-sectional view illustrating the asymmetric double-outlet blower according to the embodiment of the present disclosure and taken along the line $\overline{EF}$ in FIG. 6. Please refer to FIGS. 6 and 10. In the embodiment, the flow channel formed from the inlet 30 to the high-pressure outlet 50 has a fifth cross-sectional height H5 on the cross section taken along the line $\overline{EF}$, and the flow channel formed from the inlet 30 to the low-pressure outlet 40 has a sixth cross-sectional height H6 on the cross section taken along the line $\overline{EF}$. In the embodiment, the fifth cross-sectional height H5 is greater than the sixth cross-sectional height H6. In that, the flow channel formed from the inlet 30 to the high-pressure outlet 50 has a larger cross-sectional area compared to that of the flow channel formed from the inlet 30 to the low-pressure outlet 40, so as to provide equivalent performances under different air resistances. Consequently, a high-pressure air current flowing from the inlet 30 to the high-pressure outlet 50 and a high-pressure air current flowing from the inlet 30 to the low-pressure outlet 40 are achieved.

Figure 12:
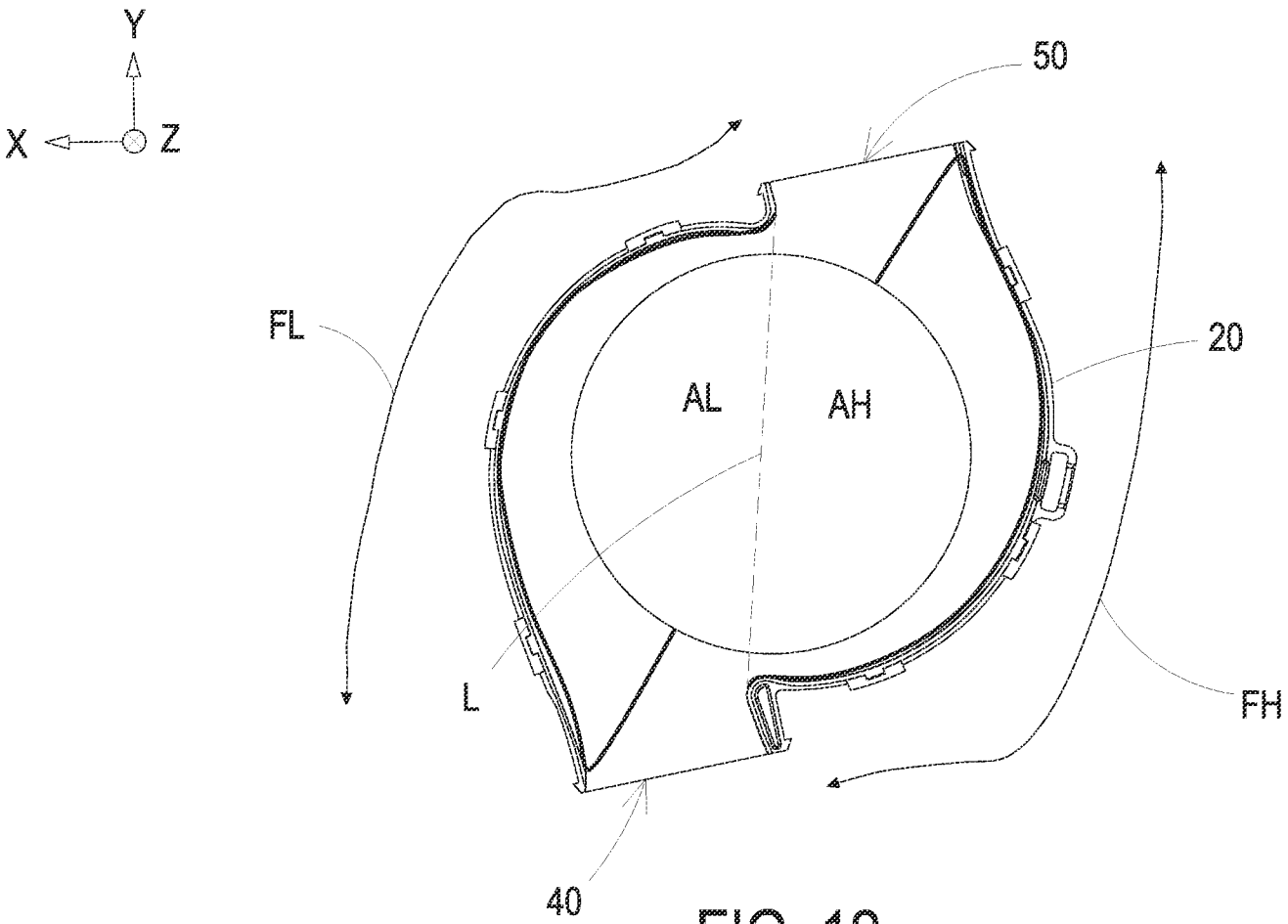
FIG. 12 schematically shows the flow channel profile of the asymmetric double-outlet blower according to the embodiment of the present disclosure.

FIG. 12 schematically shows the flow channel profile of the asymmetric double-outlet blower according to the embodiment of the present disclosure. In the blower 1 of the present disclosure, while a connection line L from the low-pressure outlet 40 close to the high-pressure outlet 50 is located through an inner lateral wall of the housing 25, a flow channel region in the housing 25 is divided into a low-pressure flow channel region AL and a high-pressure flow channel region AH by the connection line L. Referring to FIGS. 12 and 6, the connection line L is substantially overlapped to the line $\overline{AB}$. With the projection area of the high-pressure flow channel region AH designed to be greater than the projection area of the low-pressure flow channel region AL, the equivalent performances under different air resistances are provided. Thus, a high-pressure air current flowing from the inlet 30 to the high-pressure outlet 50 and a low-pressure air current flowing from the inlet 30 to the low-pressure outlet 40 are achieved. Furthermore, the low-pressure flow channel region AL and the high-pressure flow channel region AH correspondingly form a low-pressure flow channel profile FL and a high-pressure flow channel profile FH. The length of the inner lateral wall corresponding to the high-pressure flow channel profile FH is less than the length of the inner lateral wall corresponding to the low-pressure flow channel profile FL. In that, the channel length formed from the inlet 30 to the high-pressure outlet 50 is less than that formed from the inlet 30 to the low-pressure outlet 40, so as to provide equivalent performances under different air resistances. Consequently, a high-pressure air current flowing from the inlet 30 to the high-pressure outlet 50 and a low-pressure air current flowing from the inlet 30 to the low-pressure outlet 40 are achieved.

In summary, the present disclosure provides an asymmetrical double-outlet blower. The opening cross-sectional area of the high-pressure outlet is greater than the opening cross-sectional area of the low-pressure outlet, so as to provide equivalent performances under different air resistances. Consequently, a high-pressure air current flowing from the inlet to the high-pressure outlet and a low-pressure air current flowing from the inlet to the low-pressure outlet are achieved. In addition, the channel length formed from the inlet to the low-pressure outlet is longer than the channel length formed from the inlet to the high-pressure outlet, so as to provide equivalent performances under different air resistances. Consequently, a high-pressure air current flowing from the inlet to the high-pressure outlet and a low-pressure air current flowing from the inlet to the low-pressure outlet are achieved. With a cross section of the housing defined by a rotation axis, two cross-sectional heights are formed and correspond to the low-pressure outlet and the high-pressure outlet, respectively. The cross-sectional height corresponding to the low-pressure outlet is designed to be smaller than the cross-sectional height corresponding to the high-pressure outlet, so as to provide equivalent performances under different air resistances. Consequently, a high-pressure air current flowing from the inlet to the high-pressure outlet and a low-pressure air current flowing from the inlet to the low-pressure outlet are achieved. With a line connected between an inner wall of the housing located nearby the low-pressure outlet and an inner wall of the housing located nearby the high-pressure outlet, a flow channel region in the housing is divided into a low-pressure flow channel region and a high-pressure flow channel region, and the projection area of the high-pressure flow channel region is designed to be greater than the projection area of the low-pressure flow channel region, so as to provide equivalent performances under different air resistances. Consequently, a high-pressure air current flowing from the inlet to the high-pressure outlet and a low-pressure air current flowing from the inlet to the low-pressure outlet are achieved.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A double-outlet blower comprising:

an upper case comprising an inlet;

a lower case, assembled with the upper case to form a housing having an accommodation space, and form a first outlet and a second outlet, wherein the first outlet and the second outlet are in fluid communication with the inlet through the accommodation space, wherein the first outlet and the second outlet are disposed on a lateral periphery of the housing and face two opposite directions, respectively, wherein an opening cross-sectional area of the first outlet is less than that of the second outlet; and an impeller accommodated within the accommodation space of the housing, corresponding to the inlet, and rotated around a rotation axis, wherein an airflow is inhaled through the inlet and transported to the first outlet and the second outlet, respectively, wherein the lower case comprises a bottom plane, a first inclined plane and a second inclined plane, wherein the bottom plane faces the inlet, the first inclined plane is extended and sloped down from the bottom plane to the first outlet, and the second inclined plane is extended and sloped down from the bottom plane to the second outlet, wherein a first airflow flows along the first inclined plane from the bottom plane to the first outlet, a second airflow flows along the second inclined plane from the bottom plane to the second outlet, and a slope of the first inclined plane is different form a slope of the second inclined plane.

2. The double-outlet blower according to claim 1, wherein the upper case comprises a plurality of ribs and a connecting ring, the connecting ring is located in the inlet, and the plurality of ribs are extended inwardly from an outer periphery of the inlet and connected to a center of the inlet through the connecting ring.

3. The double-outlet blower according to claim 1, wherein the upper case comprises a plurality of fasteners, the lower case comprises a plurality of protrusions, the plurality of fasteners correspond to the plurality of protrusions, and each of the plurality of fasteners is buckled with the corresponding protrusion, so that the upper case and the lower case are assembled to form the housing.

4. The double-outlet blower according to claim 1, wherein the lower case comprises a plurality of attachment portions, and each of the plurality of attachment portions comprises a screw hole.

5. The double-outlet blower according to claim 1, wherein the slope of the first inclined plane is greater than that of the second inclined plane.

6. The double-outlet blower according to claim 1, wherein the upper case has an inclined plane corresponding to an outer periphery of the inlet and protruding toward an interior of the housing.

7. The double-outlet blower according to claim 6, wherein the upper case comprises a first top plane, a second top plane and a third top plane, the first top plane is connected to the inclined plane, the second top plane is extended from the first top plane to the first outlet, and the third top plane is extended from the first top plane to the second outlet, wherein the first top plane, the second top plane and the third top plane have different horizontal heights, respectively.

8. The double-outlet blower according to claim 7, wherein the horizontal height of the first top plane is greater than that of the second top plane and less than that of the third top plane.

9. The double-outlet blower according to claim 1, wherein a channel length formed from the inlet to the first outlet is longer than a channel length formed from the inlet to the second outlet.

10. The double-outlet blower according to claim 1, wherein while a cross section of the housing is defined by the rotation axis, two cross-sectional heights are formed and correspond to the first outlet and the second outlet, respectively, wherein the cross-sectional height corresponding to the first outlet is smaller than the cross-sectional height corresponding to the second outlet.

11. A double-outlet blower comprising:

an upper case comprising an inlet;

a lower case, assembled with the upper case to form a housing, and form a first outlet and a second outlet in fluid communication with the inlet, wherein the first outlet and the second outlet are disposed on a lateral periphery of the housing and face two opposite directions, respectively, wherein a channel length formed from the inlet to the first outlet is longer than a channel length formed from the inlet to the second outlet; and an impeller accommodated within the housing and rotated around a rotation axis, so that an airflow is inhaled through the inlet and transported to the first outlet and the second outlet, respectively, wherein the lower case comprises a bottom plane, a first inclined plane and a second inclined plane, wherein the bottom plane faces the inlet, the first inclined plane is extended and sloped down from the bottom plane to the first outlet, and the second inclined plane is extended and sloped down from the bottom plane to the second outlet, wherein a first airflow flows along the first inclined plane from the bottom plane to the first outlet, a second airflow flows along the second inclined plane from the bottom plane to the second outlet, and a slope of the first inclined plane is different form a slope of the second inclined plane.

12. The double-outlet blower according to claim 11, wherein an opening cross-sectional area of the first outlet is less than that of the second outlet.

13. The double-outlet blower according to claim 11, wherein while a cross section of the housing is defined by the rotation axis, two cross-sectional heights are formed and correspond to the first outlet and the second outlet, respectively, wherein the cross-sectional height corresponding to the first outlet is smaller than that corresponding to the second outlet.

14. A double-outlet blower comprising:

an upper case comprising an inlet;

a lower case, assembled with the upper case to form a housing, a first outlet and a second outlet, wherein the first outlet and the second outlet are in fluid communication with the inlet, and wherein the first outlet and the second outlet are disposed on a lateral periphery of the housing and face two opposite directions, respectively; and an impeller accommodated within the housing and rotated around a rotation axis, so that an airflow is inhaled through the inlet and transported to the first outlet and the second outlet, respectively;

wherein while a cross section of the housing is defined by the rotation axis, two cross-sectional heights are formed and correspond to the first outlet and the second outlet, respectively, wherein the cross-sectional height corresponding to the first outlet is smaller than that corresponding to the second outlet, wherein the lower case comprises a bottom plane, a first inclined plane and a second inclined plane, wherein the bottom plane faces the inlet, the first inclined plane is extended and sloped down from the bottom plane to the first outlet, and the second inclined plane is extended and sloped down from the bottom plane to the second outlet, wherein a first airflow flows along the first inclined plane from the bottom plane to the first outlet, a second airflow flows along the second inclined plane from the bottom plane to the second outlet, and a slope of the first inclined plane is different form a slope of the second inclined plane.

15. The double-outlet blower according to claim 14, wherein an opening cross-sectional area of the first outlet is less than that of the second outlet.

16. The double-outlet blower according to claim 14, wherein a channel length formed from the inlet to the first outlet is longer than that formed from the inlet to the second outlet.

* * * * *